US006839989B2

(12) United States Patent
Gessay et al.

(10) Patent No.: US 6,839,989 B2
(45) Date of Patent: Jan. 11, 2005

(54) DRILLING APPARATUS FOR HARD GROUND

(75) Inventors: Jean-Claude Gessay, Nanterre (FR); Alain Deniau, Nanterre (FR)

(73) Assignee: Compagnie du Sol, Nanterre (FR)

( * ) Notice: Subject to any disclaimer, the term of this patent is extended or adjusted under 35 U.S.C. 154(b) by 130 days.

(21) Appl. No.: 10/221,439

(22) PCT Filed: Mar. 6, 2001

(86) PCT No.: PCT/FR01/00653

§ 371 (c)(1),
(2), (4) Date: Sep. 11, 2002

(87) PCT Pub. No.: WO01/68991

PCT Pub. Date: Sep. 20, 2001

(65) Prior Publication Data

US 2003/0037464 A1 Feb. 27, 2003

(30) Foreign Application Priority Data

Mar. 13, 2000 (FR) ..... 00 03155

(51) Int. Cl.[7] ..... E02F 3/24

(52) U.S. Cl. ..... 37/189; 37/94; 175/107; 175/188; 299/59; 299/81.3

(58) Field of Search ..... 37/189, 190, 91, 37/94; 175/91, 107, 96–99, 113, 118; 299/85.2, 81.3, 59

(56) References Cited

U.S. PATENT DOCUMENTS

| | | | | | |
|---|---|---|---|---|---|
| 2,637,527 | A | * | 5/1953 | Andrews, Jr. | 175/94 |
| 3,357,506 | A | * | 12/1967 | De Bosredon | 175/99 |
| 3,443,648 | A | * | 5/1969 | Howard | 175/103 |
| 3,710,878 | A | * | 1/1973 | Endo et al. | 175/66 |
| 3,773,121 | A | * | 11/1973 | Ikeda | 175/95 |
| 3,894,587 | A | * | 7/1975 | Sourice | 175/91 |
| 4,202,416 | A | * | 5/1980 | Blaschke et al. | 175/94 |
| 4,314,615 | A | * | 2/1982 | Sodder et al. | 175/94 |
| 4,373,278 | A | * | 2/1983 | Myrick | 37/340 |
| 4,694,915 | A | * | 9/1987 | Bauer et al. | 175/91 |
| 4,742,876 | A | * | 5/1988 | Barthelemy et al. | 175/7 |
| 4,744,425 | A | * | 5/1988 | Hentschel | 175/73 |
| 4,770,255 | A | * | 9/1988 | Barthelemy et al. | 175/6 |
| 4,824,176 | A | * | 4/1989 | Barre | 299/59 |
| 5,056,242 | A | * | 10/1991 | Miotti | 37/94 |
| 5,836,089 | A | * | 11/1998 | Lipsker | 37/186 |
| 6,443,227 | B1 | * | 9/2002 | Hocking et al. | 166/250.1 |

FOREIGN PATENT DOCUMENTS

| | | | |
|---|---|---|---|
| CH | 508107 | | 5/1971 |
| DE | 4008207 | * | 8/1990 |
| JP | 54107499 | | 3/1981 |
| JP | 61273197 | | 5/1988 |
| JP | 63197772 | | 2/1990 |

* cited by examiner

*Primary Examiner*—Thomas B. Will
*Assistant Examiner*—Thomas A Beach
(74) *Attorney, Agent, or Firm*—James Ray & Associates

(57) ABSTRACT

The invention provides apparatus for drilling trenches in the ground, the apparatus comprising a frame and a drilling assembly having a horizontal support plate connected to the bottom end of the frame, said plate supporting drilling tools disposed beneath said plate, said trench being filled with a drilling mud. The periphery of said plate has resilient sealing means for co-operating with the walls of the trench so as to provide at least partial sealing between said plate and the walls of the trench, and means for adjusting drilling mud flow rates from the portion of the trench situated above said plate to the portion of the trench situated beneath said plate, and also in the opposite direction.

11 Claims, 4 Drawing Sheets

DRILLING APPARATUS FOR HARD GROUND

FIELD OF THE INVENTION

The present invention relates to apparatus for using a drill to dig trenches in the ground, and in particular in ground that is very hard.

BACKGROUND OF THE INVENTION

Trench drilling apparatuses generally using two drills are well adapted to making trenches that are deep and of relatively narrow width. French patent application 2 696 768 describes one such drilling apparatus. However, when the apparatus is required to drill into ground that is hard or very hard, such as stone, conventional machines can be found to be inadequate. The drills used at present for overburden have a maximum weight of 60 (metric) tonnes. Since such apparatuses are suspended from the end of hoisting cables, it is their own weight which is transmitted to the drills in order to perform drilling. Unfortunately, in that kind of ground, it can happen that the load required in order to achieve proper drilling lies in the range 100 tonnes to 150 tonnes, or even more. This force depends on the number of tools and the type of tool mounted on the wheels of the drill.

The simplest solution for increasing the weight of the apparatus is to load the frame of the drill. However, that would require a larger capacity hoist to be used and that naturally gives rise to major drawbacks, particularly concerning site organization.

To remedy that drawbacks, proposals have already been made in French patent No. 2 749 333 in the name of the Applicant for a particular type of drilling apparatus that enables trenches to be drilled in hard ground.

SUMMARY OF THE INVENTION

Accompanying FIG. 1 is an elevation view of the drilling apparatus described in the above-mentioned document. It comprises a main frame 10 which is suspended from the end of a pulley block 12 itself suspended from a jib. The main frame 10 has two vertical main faces, with only the front face 14 being visible. The apparatus also has a drilling assembly 16 that is movable in vertical translation at the bottom end of the main frame 10. This drilling assembly 16 essentially comprises a support structure 18 having a pump 20 mounted thereon to take up the liquid flow entraining the drilled spoil, said pump 20 being connected to a flexible removal hose. The drilling assembly also has two rotary cutters 24 and 26 secured to drums that are rotated by hydraulic motors fixed to the support assembly 18. The support assembly 18 can be moved relative to the main frame 10 by actuators 28 and 30 which serve firstly to move the drilling assembly 18 relative to the main frame 10 and secondly to apply additional force to the drilling assembly when the main frame 10 is anchored in the trench being drilled. To perform such anchoring, the main frame 10 has two shoes, of which only the shoe 32 is visible. These shoes can be moved away from the frame, e.g. by means of actuators, so as to anchor the main frame in the trench.

Such a disposition does indeed make it possible to increase the force that is applied to the cutters 24 and 26, thereby enabling them to drill into ground that is very hard. Nevertheless, given the relatively small dimensions of the active surfaces of the shoes 32 and the large force that must be developed in order to anchor the top frame, the pressure exerted by these shoes against the walls of the trench is very high. Providing the trench at the level of the shoes is of a material that is very hard, such as rock, then such pressure is acceptable. However, if the shoes are in a transition zone between relatively soft overburden that has already been drilled and rock, it is not possible to use the shoes 32 to develop the force required for achieving effective anchoring.

OBJECTS OF THE INVENTION

An object of the present invention is to provide drilling apparatus of the rotary cutter type that can be used effectively to drill a trench even in ground that is very hard and in particular when the ground has a large transition zone between relatively soft ground and very hard ground.

According to the invention, this object is achieved by an apparatus for drilling trenches in the ground, the apparatus comprising a frame and a drilling assembly having a horizontal support plate connected to the bottom end of the frame, said plate supporting drilling tools disposed beneath said plate, said trench being filled with a drilling mud, the apparatus being characterized in that the periphery of said plate has resilient sealing means for co-operating with the walls of the trench so as to provide at least partial sealing between said plate and the walls of the trench, and means for adjusting drilling mud flow rates from the portion of the trench situated above said plate to the portion of the trench situated beneath said plate, and also in the opposite direction, so that the pressure of the drilling mud beneath said plate is well below the hydrostatic pressure exerted by the column of drilling mud in the trench above said plate, and so that the flow of drilling mud extracted from the portion of the trench beneath said plate is sufficient to extract the drilling spoil that results from the drilling action of said drilling tools.

It will be understood that in this embodiment, at least partial sealing is implemented at the plate between the top portion of the trench filled with mud and the bottom portion of the trench that is being drilled because of the presence of the sealing elements at the periphery of the plate. In addition, because of the system for controlling the rate at which drilling mud flows in either direction relative to said plate, it is possible to control the pressure of the drilling mud in the portion of the trench that lies beneath said plate. This pressure can thus be maintained at a value that is relatively low, and of similar order to atmospheric pressure. Consequently, the hydrostatic pressure created by the column of drilling mud in the portion of the trench above the plate serves effectively to subject the drilling tools to the equivalent of a force corresponding to the depth of drilling mud. It will be understood that the sealing between the plate and the walls of the trench need not be completely watertight since some leakage flow can be compensated by adjusting the flow rates on either side of the plate.

In an improved embodiment, the drilling apparatus comprises a frame having two main vertical faces and the drilling assembly is vertically movable relative to the frame under drive from actuators interposed between the drilling assembly and the frame, and it is characterized in that it further comprises a plurality of inflatable elements secured to said main faces of the top frame, and means for injecting a fluid under pressure into said inflatable elements so that the inflatable elements apply a force between said main frame and the walls of the trench, and means for enabling said fluid under pressure to escape from said inflatable elements so that no force is transmitted between the main frame and the walls of the trench.

It will be understood that when the inflatable elements are in the inflated state under the effect of the pressure from the fluid, a force is transmitted between the main frame of the drilling apparatus and the walls of the trench, thereby providing a force anchoring the top frame to the trench. In this situation, the actuators enable additional force to be applied to the drilling assembly and in particular to the drilling tools thus enabling drilling to be performed in ground that is very hard. Naturally, this effect of increasing the apparent weight of the tool of the drilling apparatus is combined with the same effect that results from the low pressure beneath the plate of the drilling assembly combined with the hydrostatic pressure that results from the column of drilling mud in the trench above said plate.

DESCRIPTION OF THE DRAWINGS

Other characteristics and advantages of the invention will appear on reading the following description of various embodiments of the invention given as non-limiting examples. The description refers to the accompanying drawings, in which.

DETAILED DESCRIPTION OF THE PREFERRED EMBODIMENT

Figure 1:
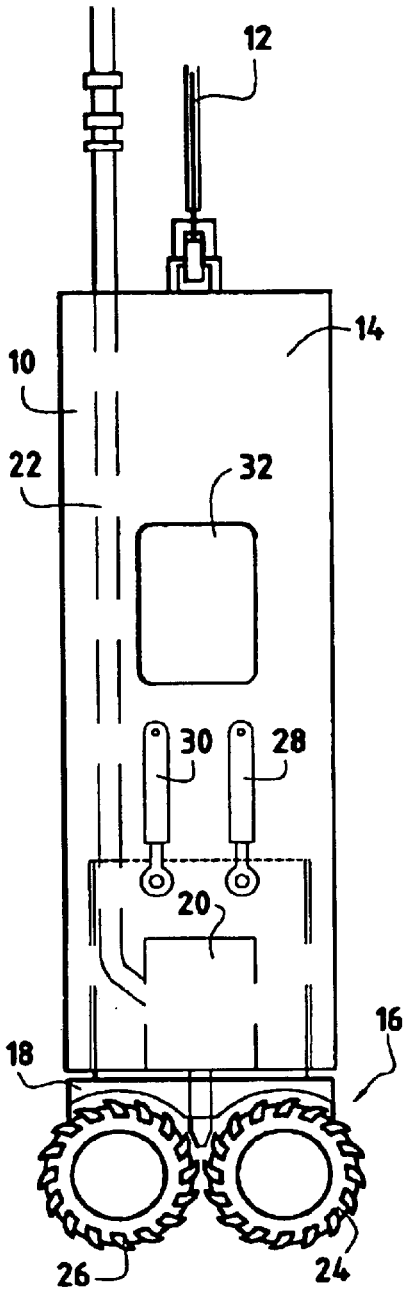
FIG.1 PRIOR ART
FIG. 1, described above, shows a prior art drilling apparatus using cutter wheels.

As already stated briefly, the invention relies on the principle of using hydrostatic pressure from the column of drilling mud in the trench above the plate of the drilling assembly for the purpose of increasing the apparent weight of the tool and thus improving the effectiveness of the cutters. For this purpose, at least partial sealing is provided between the plate and the wall of the trench by using sealing means disposed at the periphery of the plate, and a flow of drilling mud is established in one direction or the other through the plate with this flow being controlled in such a manner that the pressure of the drilling mud beneath the plate is well below the hydrostatic pressure, for example it can be about atmospheric pressure, and in addition the flow is controlled so as to take place at a rate which is sufficient to extract the spoil that results from drilling implemented by the drilling tools.

A first embodiment of the drilling apparatus is described with reference to FIG. 2. In this figure, there can be seen the frame 14, the bottom plate 18 having the drilling wheels 24 and 26 mounted on its underside, the pump 20 for sucking out the drilling mud containing the spoil, and the flexible hose 22 for removing the spoil. The pump 20 is associated with a suction nozzle 40 whose openings are located beneath the plate 18. The suction nozzle takes in the drilling mud together with the spoil. The figure also shows the trench 42 whose top portion 42*a* has already been drilled and whose bottom portion 42*b* is being drilled. In the invention, the bottom plate 18 is fitted around its periphery with a sealing gasket 44 that provides sealing between the plate 18 and the wall of the trench 42. Suitable gaskets are described in greater detail below. The plate 18 in the particular example described also has two tubes 46 and 48 passing through it to put the top portion 42*a* of the trench into communication with the bottom portion 42*b* thereof. These tubes are fitted with non-return systems and with means 46' and 48' for controlling the flow rate passing through them. It will thus be understood that the overall flow rate of drilling mud entering and leaving the bottom zone 42*b* of the trench can thus be controlled so as to control the pressure in said zone to have some value, e.g. about atmospheric pressure. Adjusting the flow rate of the suction pump makes it possible simultaneously to take account of the leakage flow that exists through the sealing zone. Nevertheless, the drilling mud flow rate must necessarily be sufficient to extract the spoil produced by the cutters 24 and 26.

Figure 3:
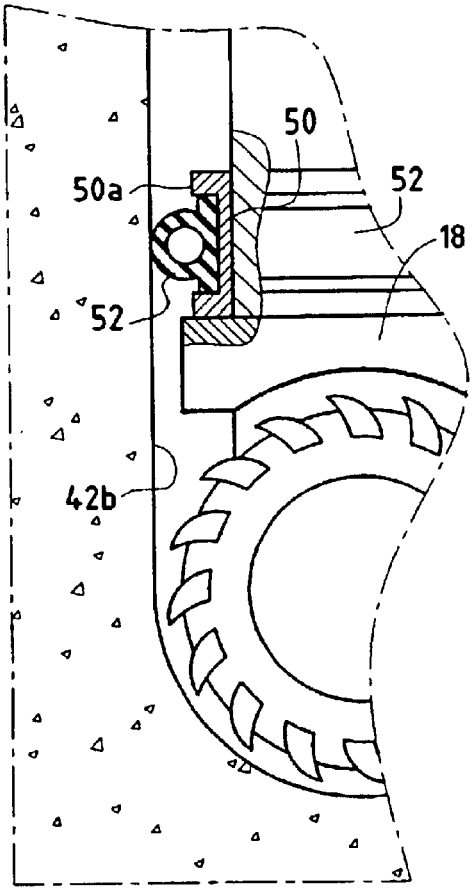
FIG. 3 is a view showing a detail of FIG. 2 for a first embodiment of the sealing between the plate and the wall of the trench.

FIG. 3 shows a first embodiment of the sealing between the plate 18 and the wall of the trench 42. The periphery of the plate 18 is provided with a vertical rim 50. A deformable rubber gasket 52 is anchored in the outside face 50*a* of the rim. The gasket 52 is made of rubber and is preferably hollow so as to be able to comply more effectively with unevenness in the wall of the trench.

Figure 4:
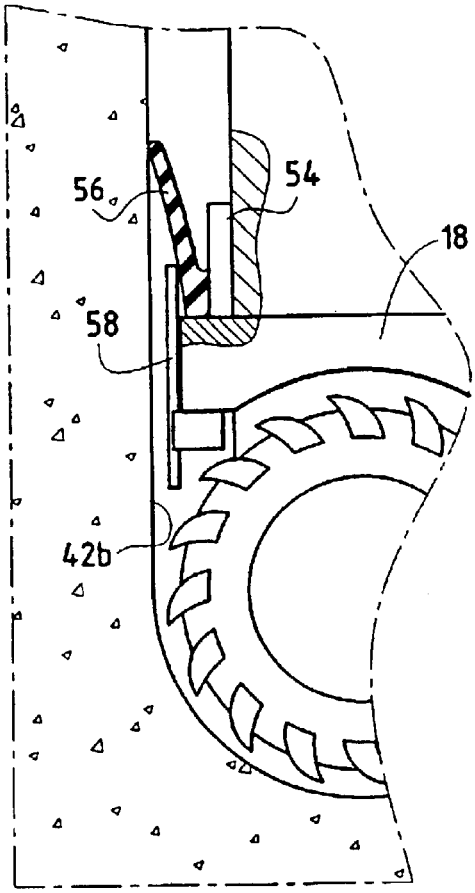
FIG. 4 is a view analogous to FIG. 3 showing a second embodiment of the sealing.

FIG. 4 shows a second embodiment of the sealing between the plate 18 and the wall of the trench 42. The periphery of the plate 18 is likewise fitted with a vertical rim 54 which goes all the way round the periphery of the plate. This rim 54 has a resilient lip gasket 56 fixed thereto which likewise goes all the way round the plate 18. The lip gasket 56 is oriented so that the effect of the end of the gasket being pressed against the wall of the trench is increased by the column of mud located above the plate 18. To make the drilling apparatus easier to raise after the trench has been made, it is preferable to provide lifting bars such as 58 which can be moved relative to the plate 18 so as to move the free end of the gasket 56 away from the wall of the trench 42.

Figure 5B:
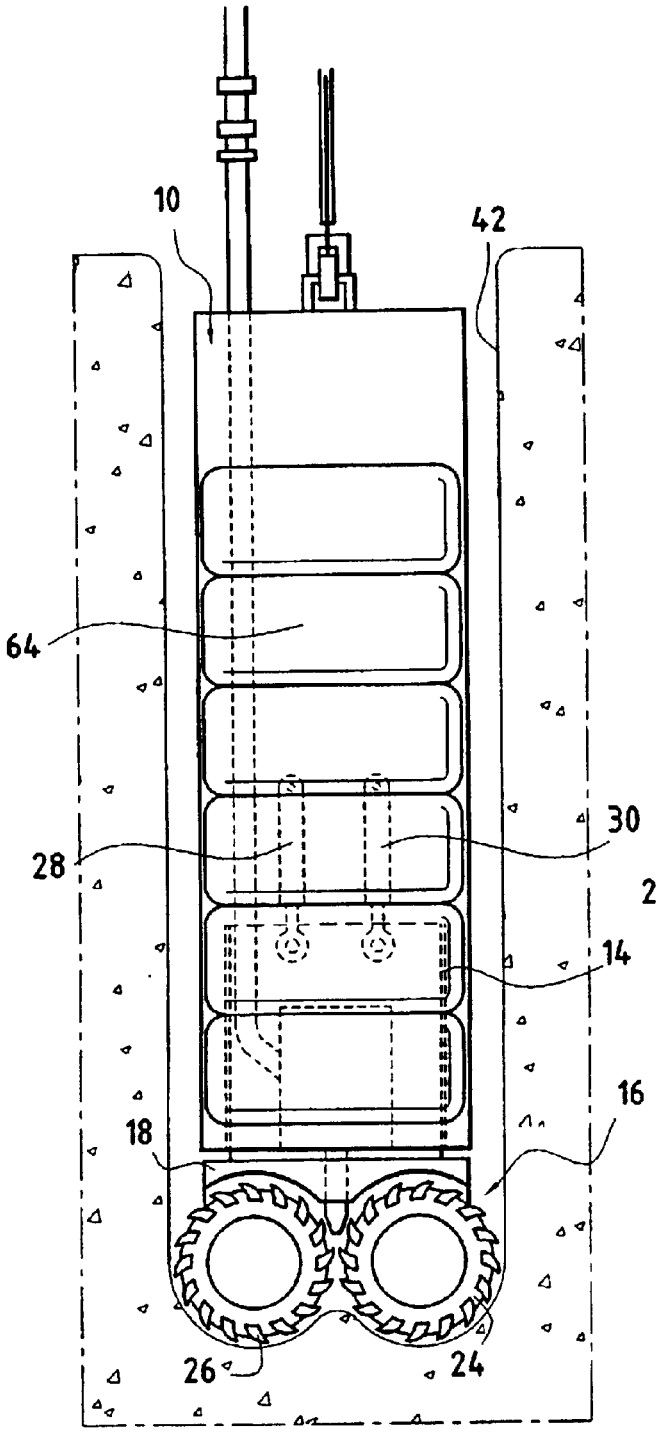
FIGS. 5A and 5B are a side view and a front view showing an improved embodiment of the drilling apparatus of the invention.
Figure 5A:
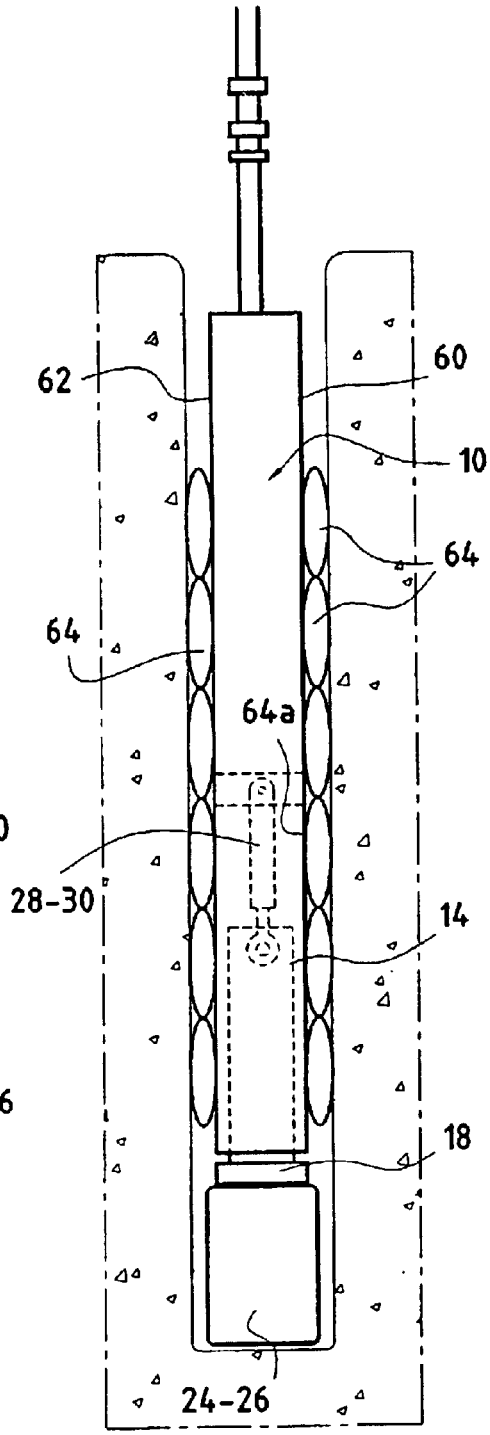

In the improved embodiment shown in FIGS. 5A and 5B, the apparent weight of the drilling apparatus is increased by combining the action of hydrostatic pressure as described above with reference to FIGS. 2 and 4 and the action of actuators on the drilling assembly which is then made to be movable relative to the main frame comprising the top portion of the drilling apparatus, with the top frame then being anchored, i.e. prevented from moving in a vertical direction relative to the trench. As explained in greater detail below, the anchoring means consist in inflatable elements such as inflatable cushions which are placed on the main faces of the top frame of the drilling apparatus and which, when inflated, enable force to be transmitted between the top portion of the frame and the facing walls of the trench being dug.

In FIGS. 5A and 5B there can be seen the main frame 14 of the apparatus and the drilling assembly 16 with its plate 18, the drilling assembly 16 being movable relative to the main frame 10 under drive from actuators 28 and 30.

In this embodiment, inflatable elements such as 64 are fixed to at least a portion of the main faces 60 and 62 of the main frame 10. By way of example, these inflatable elements occupy the entire width of the main faces and are placed substantially side by side. Each inflatable element 64 is constituted by an inflatable cushion defined by a wall of elastically deformable leakproof material. Each deformable cushion is fixed via one of its faces 64*a* to the main face 60 or 62 of the main frame, and it is connected to an individual inflation tube 66 in turn connected to a main inflation tube 68. These tubes can have adjustable pressure limiters for controlling the magnitude of the anchoring force.

Figure 2:
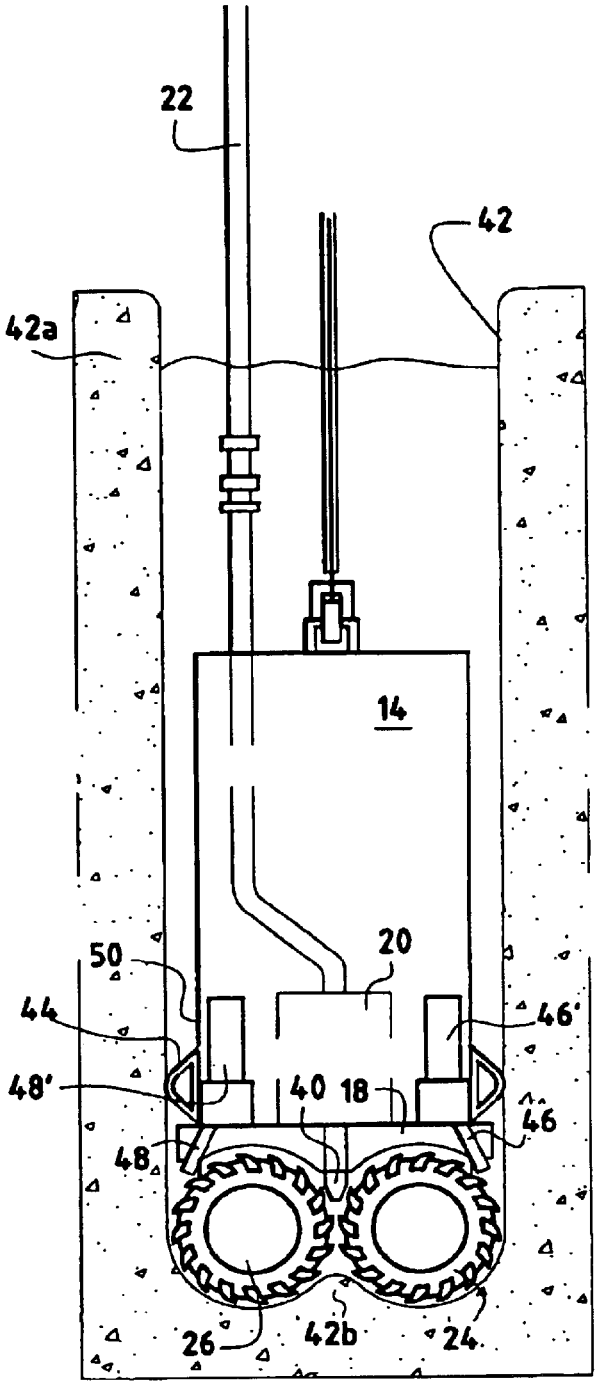
FIG. 2 is a simplified elevation view of a first embodiment of drilling apparatus of the invention.

To avoid overcrowding FIGS. 5A and 5B, these figures do not show the dispositions that are shown in FIGS. 2, 3, and 4 that enable hydrostatic pressure to act in the manner explained above. The flow rate control means 20, 40, 46', and 48' are mounted on the plate 18 of the moving portion. The sealing means 44, 52, and 56 can also be mounted at the periphery of the plate 18 of the moving portion. It is also possible to provide a sealing gasket at the bottom end of the main portion of the frame of the machine beneath the inflatable cushions 64, and also to provide a sealing gasket between the fixed portion of the frame and the moving bottom portion that carries the cutters. In either case, hydrostatic pressure acts on the top face of the moving portion in addition to the force applied by the actuators 28 and 30.

In this first embodiment, described with reference to FIG. 7A, each inflatable cushion 64 is covered by a strip 70 of a reinforced rubbery element whose edges 70*a* and 70*b* are anchored in the wall 60 of the top frame. This figure also shows one of the walls 72 of the trench being drilled. It will be understood that when a fluid (preferably liquid) under pressure is injected into the inflatable elements 64 via the tubes 66 and 68, the inflatable element increases in volume and presses the strip of rubbery material 70 against the wall 72. The pressure that exists inside the inflatable element 64 then develops a force against the wall 72 of the trench that has a horizontal component F which is converted into a vertical anchoring force F'. It will be understood that by placing a sufficient number of inflatable elements 60 on the main faces, it is possible to obtain a total vertical anchoring force that is very high without the pressure applied by the inflatable elements via the deformable strips 70 being high. Thus sufficient anchoring effect is obtained even if the nature of the material in which this portion of the trench has been dug is of limited strength.

Figure 7A:
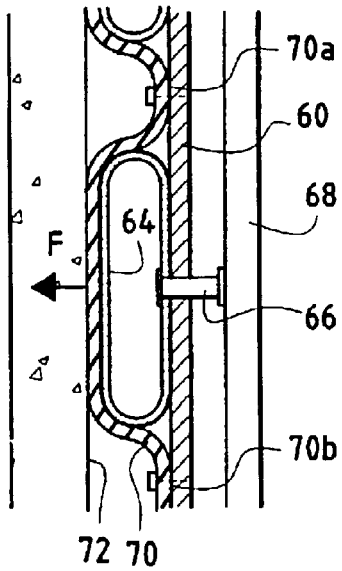
FIGS. 7A and 7B show a second embodiment of the inflatable elements of the apparatus shown in FIGS. 5A and 5B.
Figure 7B:
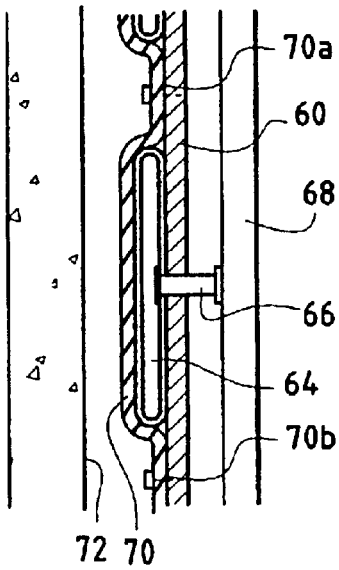

In contrast, as shown in FIG. 7B, when the inflatable element 64 is no longer under pressure, the strip 70 is moved away from the inside wall 72 of the trench and the drilling apparatus can be moved so as to drill a new section of trench.

Figure 6A:
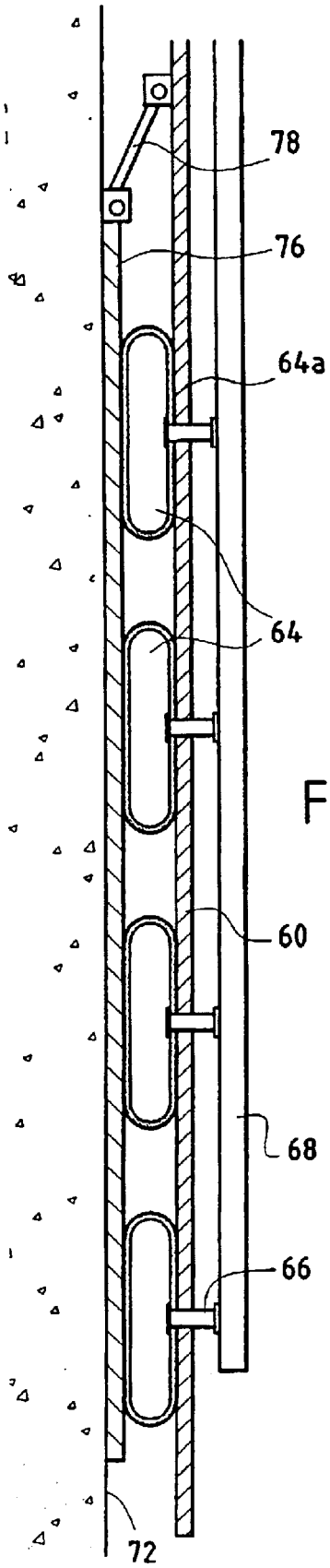
FIGS. 6A and 6B show a first embodiment of the inflatable elements for the apparatus shown in FIGS. 5A and 5B.
Figure 6B:
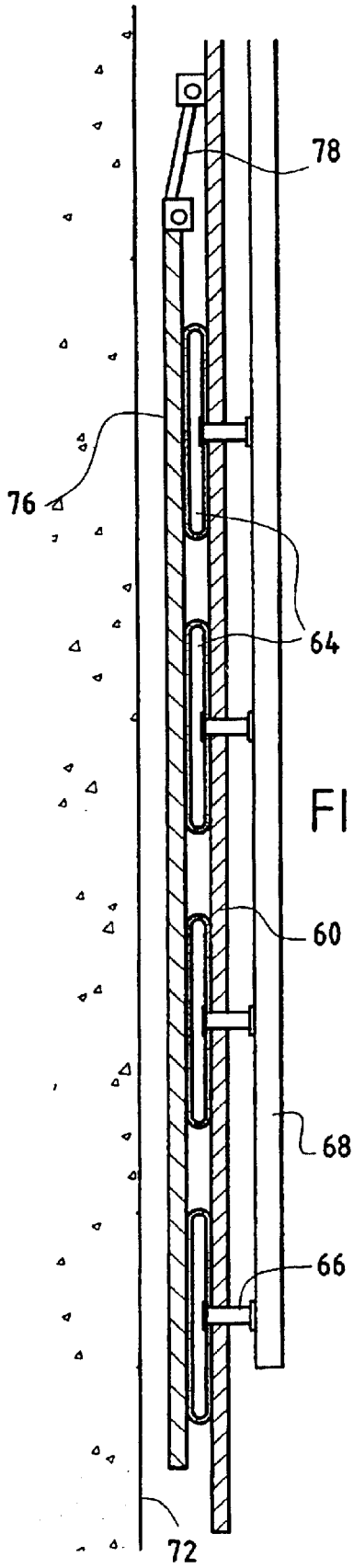

A second embodiment of the anchoring means are described below with reference to FIGS. 6A and 6B.

These anchoring means are constituted by inflatable elements 64, e.g. comprising inflatable cushions that are identical to those shown in FIGS. 7A and 7B. Each cushion 64 has one of its faces fixed to the wall 60, 62 of the main frame and connected to pressurized fluid tubes. In this second embodiment, a rigid plate 76 covers the entire surface area occupied by the inflatable elements 64 and is secured to the wall 60 via a hinged link element 78. The link element 78 is constituted by a connecting rod, for example, or more particularly by a plurality of connecting rods disposed above the top inflatable cushion 64*a*. It will be understood that when the inflatable elements 64 are indeed inflated, the rigid plate 76 is pressed against the wall 72 of the trench. This makes it possible to obtain high anchoring force while applying only limited pressure to the wall of the trench given that it is the plate 76 which is of large area that is pressed continuously against the wall of the trench.

What is claimed is:

1. Apparatus for drilling trenches in the ground, the apparatus comprising a frame and a drilling assembly having a horizontal support plate connected to the bottom end of the frame, said plate supporting drilling tools disposed-beneath said plate, said trench being filled with a drilling mud, the apparatus being characterized in that the periphery of said plate has resilient sealing means for co-operating with the walls of the trench so as to provide at least partial sealing between said plate and the walls of the trench, and means for adjusting drilling mud flow rates from the portion of the trench situated above said plate to the portion of the trench situated beneath said plate, and also in the opposite direction, so that the pressure of the drilling mud beneath said plate is well below the hydrostatic pressure exerted by the column of drilling mud in the trench above said plate, and so that the flow of drilling mud extracted from the portion of the trench beneath said plate is sufficient to extract the drilling spoil that results from the drilling action of said drilling tools.

2. Drilling apparatus according to claim 1, characterized in that said means for adjusting said flow rate comprises nozzle-forming means connected to a variable flow rate suction pump for extracting drilling mud from beneath said plate and means for adjusting a one-way flow of drilling mud from the portion of the trench situated above said plate to the portion of the trench situated beneath said plate.

3. Drilling apparatus according to claim 1, in which the frame has two main vertical faces and said drilling assembly is vertically movable relative to said frame under drive from actuators interposed between said drilling assembly and said frame, the apparatus being characterized in that it further comprises a plurality of inflatable elements secured to said main faces of the top frame, and means for injecting a fluid under pressure into said inflatable elements so that the inflatable elements apply a force between said main frame and the walls of the trench, and means for enabling said fluid under pressure to escape from said inflatable elements so that no force is transmitted between the main frame and the walls of the trench.

4. Drilling apparatus according to claim 3, characterized in that a strong layer that is movable under the effect of inflating the inflatable elements is disposed on the face of each inflatable element that faces towards the walls of the trench.

5. Drilling apparatus according to claim 4, characterized in that said moving layer is constituted by a plurality of strips of elastically deformable material having edges secured to a main face of the main frame, at least one inflatable element being interposed between said strip and said main face.

6. Drilling apparatus according to claim 4, characterized in that said moving layer is constituted by a rigid plate connected to said main face by link means allowing said plate to move in a direction that is orthogonal to said main face, said inflatable elements being interposed between said main face and said plate.

7. Drilling apparatus according to claim 3, characterized in that said inflatable elements are inflatable cushions made of a material that is leakproof and elastically deformable.

8. Drilling apparatus according to claim 2, in which the frame has two main vertical faces and said drilling assembly is vertically movable relative to said frame under drive from actuators interposed between said drilling assembly and said frame, the apparatus being characterized in that it further comprises a plurality of inflatable elements secured to said main faces of the top frame, and means for injecting a fluid under pressure into said inflatable elements so that the inflatable elements apply a force between said main frame and the walls of the trench, and means for enabling said fluid under pressure to escape from said inflatable elements so that no force is transmitted between the main frame and the walls of the trench.

9. Drilling apparatus according to claim 4, characterized in that said inflatable elements are inflatable cushions made of a material that is leakproof and elastically deformable.

10. Drilling apparatus according to claim 5, characterized in that said inflatable elements are inflatable cushions made of a material that is leakproof and elastically deformable.

11. Drilling apparatus according to claim 6, characterized in that said inflatable elements are inflatable cushions made of a material that is leakproof and elastically deformable.

* * * * *